United States Patent [19]

Kikuchi et al.

[11] Patent Number: 4,657,415

[45] Date of Patent: Apr. 14, 1987

[54] MECHANISM FOR ADJUSTING THE SPACING BETWEEN THE PRINT HEAD AND PLATEN OF A PRINTER

[75] Inventors: Hiroshi Kikuchi; Yukio Ohta; Shyoichi Watanabe, all of Tokyo, Japan

[73] Assignee: Oki Electric Industry Co., Ltd., Tokyo, Japan

[21] Appl. No.: 743,968

[22] Filed: Jun. 12, 1985

[30] Foreign Application Priority Data

Jun. 12, 1984 [JP] Japan ..... 59-86128[U]

[51] Int. Cl.[4] ..... B41J 11/20

[52] U.S. Cl. ..... 400/59; 400/57; 400/355

[58] Field of Search ..... 400/352, 55, 354, 57, 400/355, 56, 357, 58, 59, 124; 101/365

[56] References Cited

U.S. PATENT DOCUMENTS

| | | | |
|---|---|---|---|
| 2,986,256 | 5/1961 | Salzberger | 400/59 |
| 3,155,032 | 11/1964 | Antonucci | 400/58 |
| 3,666,071 | 5/1972 | Purr | 400/59 |
| 3,817,365 | 6/1974 | Zimmermann | 400/124 |
| 4,023,662 | 5/1977 | Perucca | 400/59 |
| 4,300,847 | 11/1981 | Hoffman et al. | 400/59 |
| 4,384,794 | 5/1983 | Okano et al. | 400/59 |
| 4,390,292 | 6/1983 | Krenz | 400/59 |
| 4,402,264 | 9/1983 | Weisgerber | 101/365 |
| 4,408,907 | 10/1983 | Bernardis | 400/124 |
| 4,420,269 | 12/1983 | Ackermann et al. | 400/59 |
| 4,469,459 | 9/1984 | Trezise et al. | 400/59 |
| 4,514,101 | 4/1985 | Smith | 400/59 |
| 4,525,084 | 6/1985 | Ikeda | 400/59 |

FOREIGN PATENT DOCUMENTS

| | | | |
|---|---|---|---|
| 48309 | 9/1983 | Japan | 400/59 |

*Primary Examiner*—William Pieprz

*Attorney, Agent, or Firm*—Wenderoth, Lind & Ponack

[57] ABSTRACT

A shoe in the form of a cylindrical screw is rotatably threaded through a carriage supporting a print head and has one end held slidably against a guide rail parallel to a main guide shaft on which the carriage is movable parallel to the platen of an impact printer. The shoe is rotated about its own axis to tilt the carriage and hence the print head to adjust the spacing between the print head and the platen. The shoe is rotated by a gap change lever angularly movably supported on the carriage and having teeth for mesh with a gear mounted on the shoe. For initializing the spacing between the print head and the platen, the gear on the shoe is displaced out of mesh with the teeth of the gap change lever and rotated to turn the shoe. To achieve a desired spacing between the print head and the platen, the gear on the shoe is moved into mesh with the teeth of the gap change lever, and the gap change lever is turned to rotate the gear and the shoe for angular movement of the carriage.

10 Claims, 7 Drawing Figures

MECHANISM FOR ADJUSTING THE SPACING BETWEEN THE PRINT HEAD AND PLATEN OF A PRINTER

BACKGROUND OF THE INVENTION

1. Field of the Invention

The present invention relates to a mechanism for adjusting the spacing or gap between the print head and platen of a serial printer in which characters and other images are printed on a print medium placed on the platen by the print head as it traverses the platen.

2. Description of the Related Art

Impact-type serial printers have a print head and a platen which are spaced from each other by a gap or spacing (hereinafter also referred to as a "platen gap") which is dependent on the response and output energy of the print head. The platen gap is required to be adjustable also dependent on the number of print media or sheets to be copied simultaneously and the thickness of a sheet or sheets placed between the platen and the print head.

Prior mechanisms for adjusting the platen gap are disclosed in Japanese Laid-Open Patent Publications Nos. 58-90975 and 58-175951, for example. The known platen gap adjusting mechanisms will be described with reference to FIGS. 6 and 7 of the accompanying drawings.

As shown in FIG. 6, a print head 1 is mounted on a carriage 2 with an eccentric bushing 3 fixed to an end thereof, the eccentric bushing 3 having an axial eccentric hole 4 defined therein. The carriage 2 has an elliptical hole 5 defined in the opposite end thereof remote from the eccentric bushing 3. Guide shafts 6, 7 are slidably inserted respectively in the hole 4 in the eccentric bushing 3 and the elliptical hole 5 in the carriage 2. A platen 8 is positioned such that it presents a print surface in confronting relation to the print head 1. The guide shafts 6, 7 and the platen 8 are supported in parallel relation by and between two frames 9, 10.

The carriage 2 with the print head 1 supported thereon is movable in the directions of the arrow 11 while sliding on and along the guide shafts 6, 7.

For adjusting the platen gap between the print head 1 and the platen 8, the eccentric bushing 3 is turned on the guide shaft 6 to displace the carriage 2 in the directions of the arrow 12. More specifically, as the eccentric bushing 3 is turned on the guide shaft 6, the eccentric bushing 3 is transversely displaced with respect to the guide shaft 6 to impart a similar transverse displacement to the carriage 2, which is allowed by the elliptical hole 5 in the carriage 2.

The platen gap is adjusted dependent on the number of print sheets to be copied simultaneously and the thickness of a sheet or sheets placed between the platen 8 and the print head 1.

Since each of the print head 1 and the carriage 2 is made up of a number of parts, the platen gap should be initialized taking into account the accumulated dimensional tolerances of the components of the print head 1 and the carriage 2. At the time the platen gap has been initialized, the angular phase of the eccentric bushing 3 varies from printer to printer. In addition, the eccentric bushing 3 can vary the platen gap to a limited extent since it is angularly movable for transverse displacement only in a limited range. For the above reasons, when varying the initialized platen gap to meet a print sheet or sheets used, a desired platen gap may not be achieved through the available angular movement of the eccentric bushing 3.

U.S. Pat. No. 4,390,292 to Krenz discloses a prior mechanism for adjusting the spacing between the print head and platen of a line printer.

SUMMARY OF THE INVENTION

In view of the problems of the conventional platen gap adjustment mechanisms, it is an object of the present invention to provide a mechanism for adjusting the spacing or platen gap between a print head and a platen to a greater extent.

According to the present invention, a mechanism for adjusting the spacing between the print head and platen in a printer includes a side frame, a main guide shaft supported by the side frame, a carriage supporting the print head thereon and movable on and along the main guide shaft, a guide rail extending parallel to the main guide shaft, a shoe rotatably threaded through the carriage and held slidably against the guide rail, a gear vertically movably mounted on an end of the shoe for angular movement therewith, and a gap change lever angularly movably mounted on the carriage and having teeth for mesh with the gear. In operation, the gear is vertially moved out of mesh with the teeth of the gear change lever, and the shoe is turned to turn the carriage vertically for initializing the spacing between the print head and the platen. Then, the gear is vertically moved into mesh with the teeth of the gap change lever. The gap change lever is turned to turn the gear and the shoe to angularly move the carriage to achieve the desired spacing.

Since the spacing or platen gap between the print head and the platen can be adjusted by turning the gap change lever, the adjustable extent of the spacing is greater than that which can be achieved by the conventional eccentric bushing. The platen gap can easily be initialized by turning the gear and the shoe, and the desired platen gap can also easily be achieved by turning the gap change lever.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
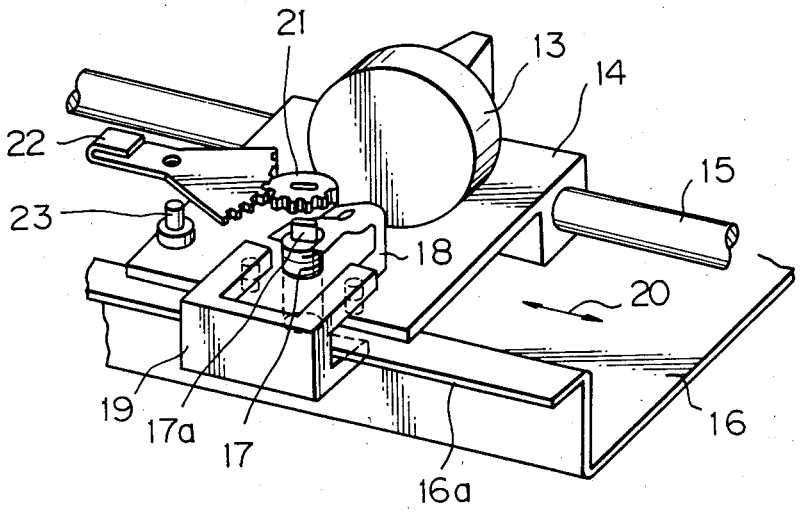
FIG. 1 is a perspective view of a mechanism for adjusting the spacing or platen gap between a print head and a platen, according to the present invention.

As shown in FIG. 1, an impact printer includes a print head 13 mounted on a carriage 14 slidably supported on a main guide shaft 15 extending through a front end of the carriage 14 near the print head 13. A base frame 16 disposed below the carriage 14 extends parallel to the main guide shaft 15 for a length over which the carriage 14 is movable. The base frame 16 has a guide rail 16*a* extending closely to the opposite rear end of the carriage 14 remote from the print head 13. A shoe 17 in the form of a cylindrical screw is rotatably threaded through the carriage 14 and has an end held in abutment against the guide rail 16*a*. A flat shaft 17*a* projects from the upper end of the shoe 17. A leaf spring 18 mounted on the carriage 14 extends toward and engages the upper end of the shoe 17. The leaf spring 18 on the carriage 14 and the guide rail 16*a* are gripped by a guide member 19 fixed to the end of the carriage 14 and held in position against wobbles under the biasing force of the leaf spring 18. The guide member 19 is also held slidably against the guide rail 16*a*. Therefore, the guide member 19 is slidable on the guide rail 16*a* as the carriage 14 is moved, so that the carriage 14 can be moved unobstructedly in the directions of the arrow 20.

Figure 2:
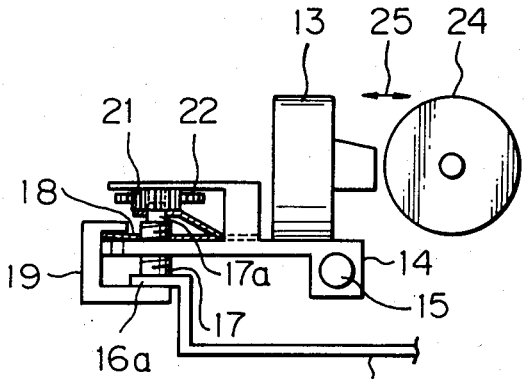
FIG. 2 is a side elevational view of the mechanism shown in FIG. 1.
Figure 3:
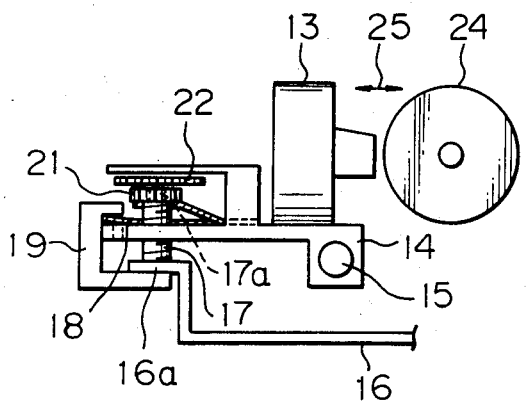
FIG. 3 is a side elevational view of the mechanism, illustrating the manner in which the platen gap is initialized.

A gear 21 is vertically movably mounted on the flat shaft 17*a* on the shoe 17, the gear 21 having teeth on its partial peripheral edge and also having a tooth-free peripheral edge. A gap change lever 22 is angularly movable about a post 23 mounted on the carriage 14 and has sectorial gear teeth on one end thereof which are held in mesh with the teeth of the gear 21. As shown in FIGS. 2 and 3, a cylindrical platen 24 is positioned in confronting relation to the print head 13.

Operation of the platen gap adjustment mechanism thus constructed will be described with reference to FIGS. 1 through 3. First, the gear 21 is manually depressed out of mesh with the gap change lever 22 as shown in FIG. 3. Then, the gear 21 is manually turned to turn the shoe 17 for thereby vertically moving the rear end of the carriage 14 to move the print head 13 in the directions of the arrow 25. Therefore, the spacing or platen gap between the print head 13 and the platen 24 is initialized.

The gear 21 as fitted over the flat shaft 17*a* on the shoe 17 is then allowed to move upwardly under the biasing force of the leaf spring 18 to bring the gear 21 into mesh with the teeth of the gap change lever 22. Thereafter, the gap change lever 22 is turned through a prescribed angle to turn the gear 21 and the shoe 17 to move the rear end of the carriage 14 for an upward or downward interval for moving the print head 13 in the directions of the arrow 25 to achieve a desired platen gap.

According to the principles of the present invention, the platen gap is adjusted by turning the shoe 17. While in the above embodiment the shoe 17 is turned by the gear 21 and the gap change lever 22, the invention is not limited to the foregoing arrangement, but the shoe 17 may be turned by a turning means fitted directly over the shoe 17.

A mechanism for turning the gap change lever 22 will be described with reference to FIGS. 4 and 5.

The gap change lever 22 supports a roller 26 on its end remote from the sectorial gear teeth. A limiter 27 is mounted on an end of the main guide shaft 15 for setting a home position of the carriage 14. The main guide shaft 15 and the base frame 16 are supported by and between side frames 28 (only one shown in FIG. 4). A bracket 29 is mounted on one of the side frames 28, and partly extends into an opening defined in the side frame 28. The bracket 29 supports thereon a post 30 and a spring post 31 which extend upwardly in parallel relation. A plate cam 32 for engaging the roller 26 on the gap change lever 22 has a central arcuate slot 32*a* through which the spring post 31 extends. The plate cam 32 is angularly movably mounted on the post 30 on the bracket 29. Therefore, the plate cam 32 is limited in its angular movement about the post 30 by the arcuate slot 32*a*. A detent spring 33 has one end coupled to the spring post 31 and the other end coupled to a spring post 32*b* on the plate cam 32 for normally urging the plate cam 32 to turn in one direction about the post 30.

The mechanism shown in FIGS. 4 and 5 operates as follows: First, a power supply (not shown) for the impact printer is switched on to move the carriage 14 in the direction of the arrow 34 (FIG. 5) toward its starting or original position adjacent to the side frame 28 until the carriage 14 abuts against the limiter 27. The original position of the carriage 14 may be detected by a sensor rather than the limiter 27. After the carriage 14 has reached the original position, the carriage 14 is moved for a prescribed interval in the direction of the arrow 35 to reach a position A that serves as a home position. The carriage 14 will move between the position A and a postition B (FIG. 5) during printing operation.

After a print sheet or sheets have been set in the printer, the platen gap is required to be adjusted to meet the thickness of the print sheet or sheets. The gap change lever 22 is now manually turned in the direction of the arrow 36 (FIG. 5) toward a set position. Then, when the printer is powered, the carriage 14 which has been stopped somewhere between the positions A, B is moved in the direction of the arrow 34 until the roller 26 on the gap change lever 22 engages the plate cam 32, whereupon the gap change lever 22 is turned to the dot-and-dash-line position shown in FIG. 5. The gear 21 and the shoe 17 are turned together to move the carriage 14 for angularly moving the print head 25 in the directions of the arrow 25 to achieve a desired platen gap. At the same time, the carriage 14 is held against the limiter 27 to complete the positioning of the carriage 14 into its original position.

After the platen gap has been adjusted and the carriage 14 has been brought into the original position simultaneously, the carriage 14 is moved in the direction of the arrow 35 to the home position A in readiness for printing operation.

Figure 4:
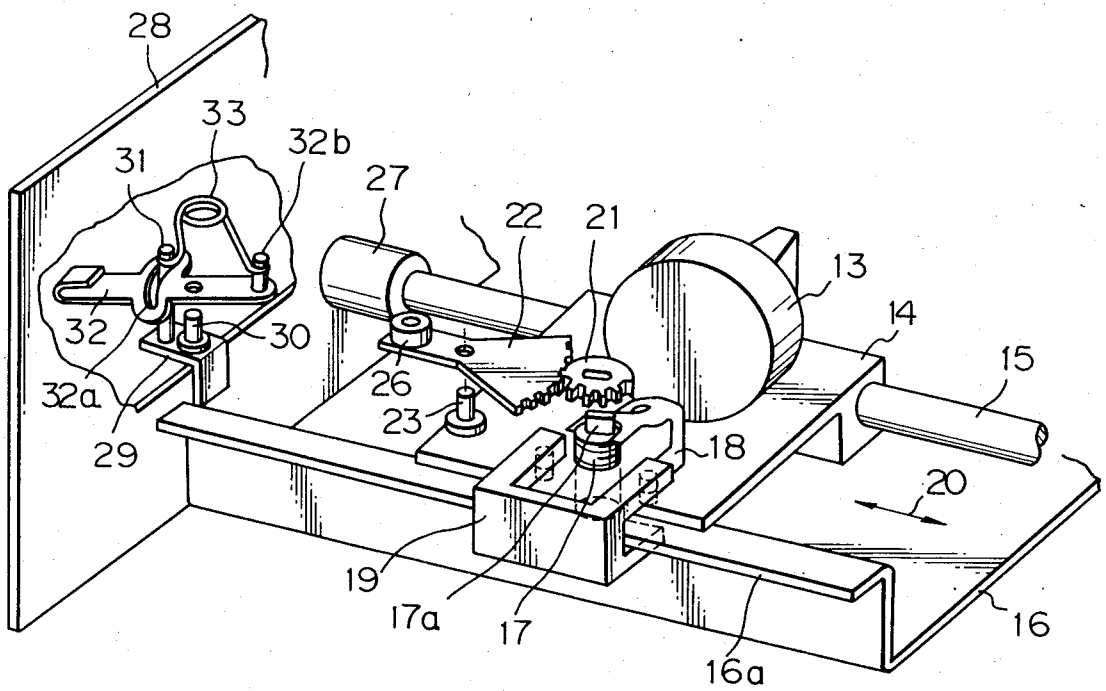
FIG. 4 is a perspective view of a mechanism for turning a gap change lever.
Figure 5:
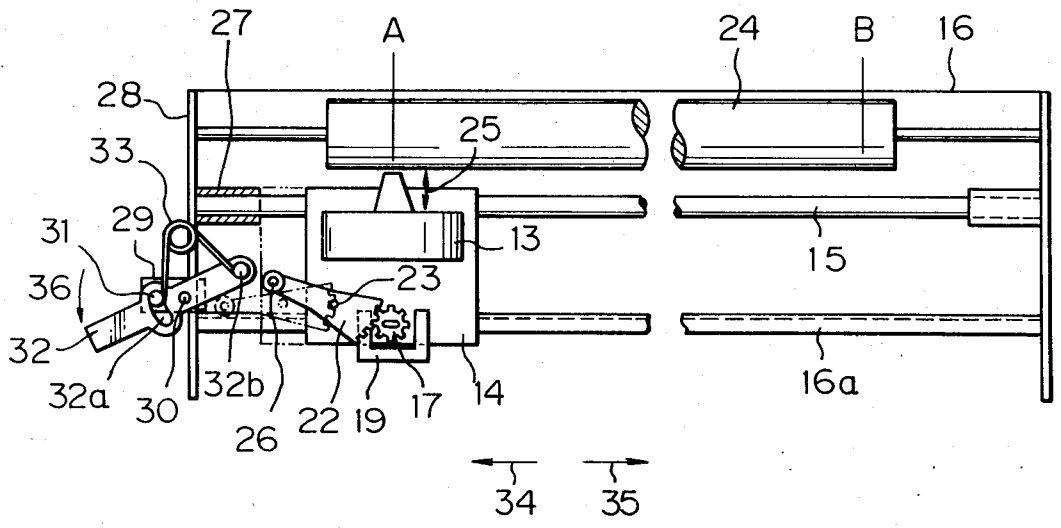
FIG. 5 is a plan view of the mechanism shown in FIG. 4.
Figure 6:
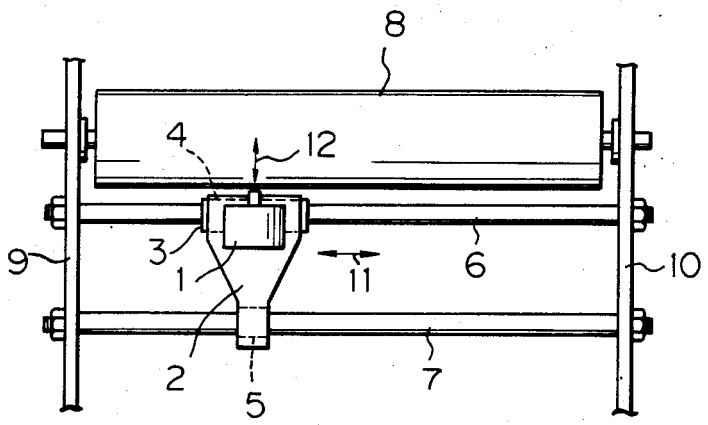
Fig. 6 PRIOR ART
FIG. 6 is a plan view of a conventional platen gap adjusting mechanism.
Figure 7:
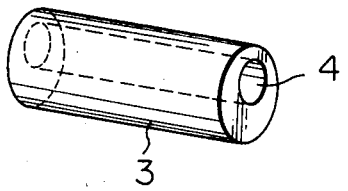
Fig. 7 PRIOR ART
FIG. 7 is a perspective view of an eccentric bushing employed in the mechanism of FIG. 6.

With the mechanism shown in FIGS. 4 and 5, the platen gap can freely be adjusted by turning then plate cam 32 in the direction of the arrow 36. The plate cam 32 may automatically be set simply by means of a latching solenoid or the like. The plate cam 32 has its lever end projecting out of a printer enclosure or housing, including the side frame 28 shown in FIG. 4, so that the plate cam 32 can easily be actuated by the operator.

Although a certain preferred embodiment has been shown and described, it should be understood that many changes and modifications may be made therein without departing from the scope of the appended claims.

What is claimed is:

1. A mechanism for adjusting the spacing between the print head and platen in a printer, comprising:

a side frame;
a main guide shaft supported on said side frame;
a carriage for supporting the print head thereon and movable axially along and rotatably about said main guide shaft;
a guide rail extending parallel to said main guide shaft in fixed relation thereto;
a shoe in threaded engagement with said carriage, vertically extending and rotatably threaded through said carriage into sliding contact with said guide rail such that rotation of said shoe in opposite angular directions respectively moved said carriage in respective vertical directions toward and away from said guide rail;
means for holding said shoe in sliding contact with said guide rail;
a gear vertically movably mounted on an end of said shoe for angular movement therewith; and
a gap change lever angularly movable mounted on said carriage and having teeth for mesh with said gear such that angular movement of said gap change lever with said teeth in mesh with said gear rotates said shoe.

2. A mechanism according to claim 1, wherein said shoe is a vertically extending cylindrical screw having one end held by said holding means slidably against said guide rail, said cylindrical screw including a flat shaft projecting from an end of said cylindrical screw opposite said one end, said gear being fitted over said flat shaft.

3. A mechanism according to claim 1, wherein said teeth of said gap change lever comprise sectorial gear teeth on one end of said gap change lever.

4. A mechanism as in claim 1, further comprising a print head mounted on said carriage adjacent said main guide shaft, whereby movement of said carriage in respective directions toward and away from said guide rail pivots said print head away from and toward the platen when the platen is disposed adjacent said main guide shaft.

5. A mechanism for adjusting the spacing between the print head and platen in a printer, comprising:
a side frame;
a main guide shaft supported on said side frame;
a carriage for supporting the print head thereon and movable axially along and rotatably about said main guide shaft;
a guide rail extending parallel to said main guide shaft in fixed relation thereto;
a shoe in threaded engagement with said carriage, vertically extending and rotatably threaded through said carriage into sliding contact with said guide rail such that rotation of said shoe in opposite angular directions respectively moves said carriage in respective vertical directions toward and away from said guide rail;
means for holding said shoe in sliding contact with said guide rail;
a gear vertically movably mounted on an end of said shoe for angular movement therewith;
a gap change lever angularly movable mounted on said carriage and having teeth for mesh with said gear such that angular movement of said gap change lever with said teeth in mesh with said gear rotates said shoe; and
means on said side frame for turning said gap change lever, turning of said gap change lever in mesh with said gear rotating said shoe so as to change a spacing between said carriage and said guide rail and thereby rotates said carriage about said main guide shaft to adjust a distance between the print head on said carriage and the platen when said carriage is in a position adjacent said side frame.

6. A mechanism according to claim 5, wherein said shoe is a cylindrical screw having one end held slidably by said holding means against said guide rail, said cylindrical screw including a flat shaft projecting from an end of said cylindrical screw opposite said one end, said gear being fitted over said flat shaft.

7. A mechanism according to claim 5, wherein said teeth of said gap change lever comprise sectorial gear teeth on one end of said gap change lever.

8. A mechanism according to claim 5, wherein said turning means comprises a plate cam angularly movably mounted on said side frame for engaging said gap change lever to turn said gap change lever.

9. A mechanism as in claim 5, further comprising a print head mounted on said carriage adjacent said main guide shaft, whereby movement of said carriage in respective directions toward and away from said guide rail pivots said print head away from and toward the platen when the platen is disposed adjacent said main guide shaft.

10. A mechanism for adjusting the spacing between the print head and platen in a printer, comprising:
a side frame;
a main guide shaft supported on said side frame;
a carriage for supporting the print head thereon and movable axially along and rotatably about said main guide shaft;
a guide rail extending parallel to said main guide shaft in fixed relation thereto;
a shoe in threaded engagement with said carriage, vertically extending and rotatably threaded through said carriage into sliding contact with said guide rail such that rotation of said shoe in opposite angular directions respectively moves said carriage in respective directions toward and away from said guide rail;
means for holding said shoe in sliding contact with said guide rail;
a gear vertically movably mounted on an end of said shoe for angular movement therewith;
a gap change lever angularly movable mounted on said carriage and having teeth for mesh with said gear such that angular movement of said gap change lever with said teeth in mesh with said gear rotates said shoe; and
means, on said side frame, for turning said gap change lever, turning of said gap change lever in mesh with said gear rotating said shoe so as to change a spacing between said carriage and said guide rail and thereby rotates said carriage about said main guide shaft to adjust a distance between the print head on said carriage and the platen when said carriage is in a position adjacent said side frame;
said turning means including a plate cam having an arcuate slot, angularly movably mounted on said side frame for engaging said gap change lever to turn said gap change lever, a bracket mounted on said side frame, a first post mounted on said bracket, a second post mounted on said bracket so as to extend through said arcuate slot, a roller supported on an end of said gap change lever remote from said teeth for engagement with said plate cam, and a spring acting between said plate cam and said second post so as to normally urge said plate cam to turn in one direction about said first post within an interval defined by said arcuate slot and into engagement with said plate cam when said carriage is in said position adjacent said side frame.

* * * * *